US008579126B1

(12) United States Patent
Cole

(10) Patent No.: US 8,579,126 B1
(45) Date of Patent: Nov. 12, 2013

(54) FRUIT DISPLAY STAND

(76) Inventor: Lars I. Cole, Alexandria, VA (US)

( * ) Notice: Subject to any disclaimer, the term of this patent is extended or adjusted under 35 U.S.C. 154(b) by 167 days.

(21) Appl. No.: 13/223,078

(22) Filed: Aug. 31, 2011

(51) Int. Cl.

| | |
|---|---|
| ***A47B 75/00*** | (2006.01) |
| ***A47F 5/04*** | (2006.01) |
| ***A47F 7/00*** | (2006.01) |
| ***D06F 57/08*** | (2006.01) |
| ***D06F 57/04*** | (2006.01) |

(52) U.S. Cl.
USPC ..... 211/85.24; 211/196; 211/197; 211/175; 211/182

(58) Field of Classification Search
USPC ..... 211/85.4, 13.1, 175, 205, 195, 196, 211/197, 85.24, 172, 182; 248/161, 157, 248/125.8, 122.1, 127; 108/154, 155, 143, 108/150; 135/121–122, 147, 159, 98, 120.3
See application file for complete search history.

(56) References Cited

U.S. PATENT DOCUMENTS

| | | | | | |
|---|---|---|---|---|---|
| 146,308 | A | * | 1/1874 | Boorn | 211/197 |
| 204,179 | A | * | 5/1878 | Wilson | 211/197 |
| 430,970 | A | * | 6/1890 | Reed | 211/167 |
| 438,517 | A | * | 10/1890 | Adams | 211/163 |
| 443,920 | A | * | 12/1890 | Reed | 211/163 |
| 450,146 | A | * | 4/1891 | Gibford | 211/77 |
| 542,362 | A | | 7/1895 | Ganzhorn | |
| 843,712 | A | * | 2/1907 | Straue | 211/197 |
| 890,381 | A | * | 6/1908 | Shults | 211/12 |
| 1,018,637 | A | | 2/1912 | Shults | |
| 1,072,347 | A | * | 9/1913 | Miller et al. | 108/28 |
| 1,078,804 | A | | 11/1913 | Royse | |
| 1,232,923 | A | | 7/1917 | Howeth | |
| 1,306,297 | A | | 6/1919 | Auerochs | |
| 1,576,629 | A | * | 3/1926 | Culp | 211/197 |
| 1,590,220 | A | * | 6/1926 | Wurts | 211/197 |
| 1,754,998 | A | | 4/1930 | Geartts | |
| 1,790,798 | A | | 2/1931 | Davis | |
| 1,940,746 | A | * | 12/1933 | Ford | 211/196 |
| 2,038,903 | A | | 4/1936 | Rakatzky | |
| 2,066,478 | A | | 1/1937 | Lewin, Jr. | |
| 2,207,731 | A | * | 7/1940 | Hagopian | 211/85.4 |
| 2,274,139 | A | * | 2/1942 | Goldthwait et al. | 211/197 |
| 2,474,922 | A | * | 7/1949 | Unwin | 211/167 |
| 2,661,849 | A | * | 12/1953 | Van Spalding | 211/2 |
| D176,793 | S | * | 1/1956 | Kinzie | D6/458 |
| D184,002 | S | * | 12/1958 | Canning | D6/405 |
| 3,955,787 | A | * | 5/1976 | Brown | 248/159 |
| 4,550,840 | A | | 11/1985 | Van Deursen | |
| 4,676,381 | A | | 6/1987 | Wiister | |
| 4,735,326 | A | * | 4/1988 | Steiner | 211/197 |
| 4,830,202 | A | * | 5/1989 | Steiner | 211/197 |
| 4,895,261 | A | * | 1/1990 | Yacobian | 211/196 |
| 5,199,580 | A | | 4/1993 | Bankier | |
| 5,280,841 | A | * | 1/1994 | Van Deursen | 211/197 |
| 5,377,849 | A | * | 1/1995 | Martin | 211/85.7 |
| 5,449,075 | A | * | 9/1995 | Meade et al. | 211/197 |
| 5,647,493 | A | * | 7/1997 | Sippel | 211/194 |

(Continued)

*Primary Examiner* — Jennifer E Novosad
(74) *Attorney, Agent, or Firm* — Shlesinger, Arkwright & Garvey LLP

(57) ABSTRACT

A fruit display stand comprises a base; a first post secured to the base; transverse arms secured to an upper end portion of the first post, the transverse arms extending upwardly inclinedly from the first post; a plurality of ring members attached to the transverse arms. The ring members include an outer ring member. Other of the ring members are disposed within the outer ring member in plan view; and the other of the ring members are disposed vertically below the outer ring member.

21 Claims, 9 Drawing Sheets

(56) References Cited

U.S. PATENT DOCUMENTS

| | | | | |
|---|---|---|---|---|
| D400,372 | S | 11/1998 | Poderis | |
| 6,164,616 | A | 12/2000 | Woods et al. | |
| 6,854,609 | B1 | 2/2005 | Hettinger | |
| D544,163 | S * | 6/2007 | Meltzer | D32/58 |
| 2005/0040125 | A1 * | 2/2005 | Wuster | 211/197 |
| 2005/0056606 | A1 * | 3/2005 | Tsai | 211/195 |
| 2007/0295379 | A1 * | 12/2007 | Basta | 135/122 |

* cited by examiner

FIG. 2
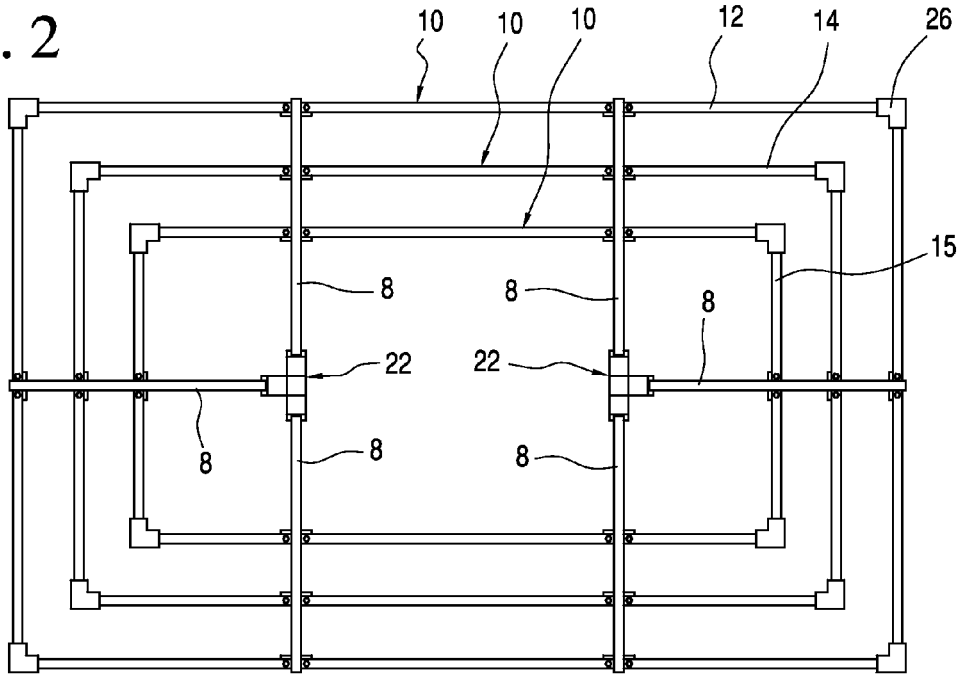
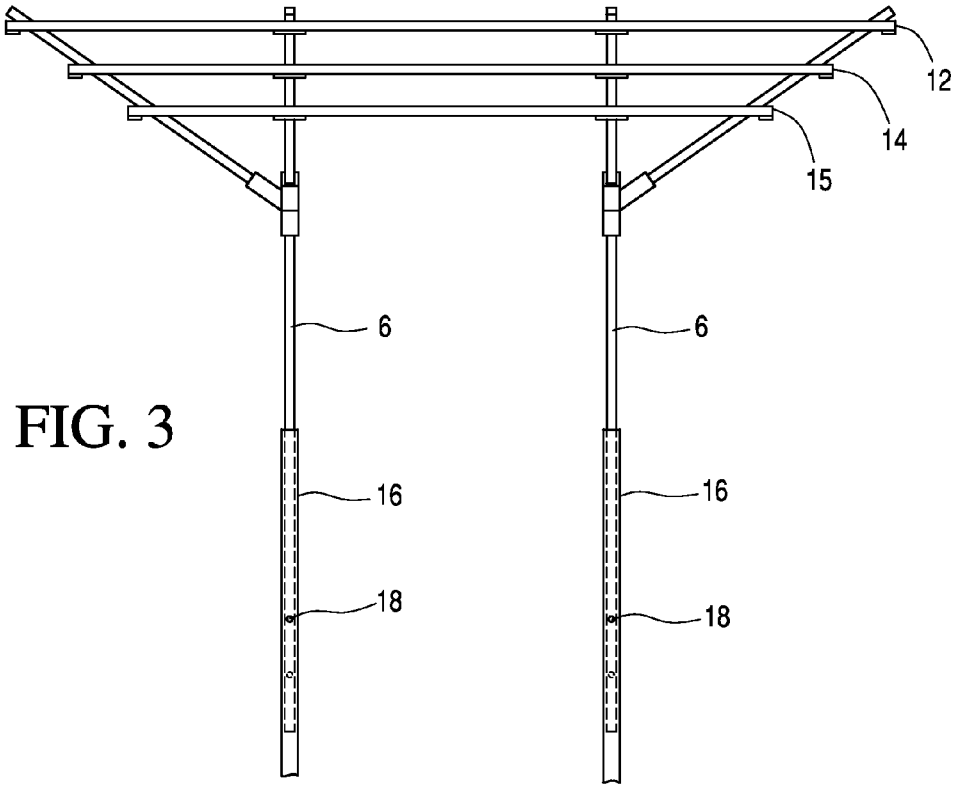
FIG. 3

FRUIT DISPLAY STAND

FIELD OF THE INVENTION

The present invention relates generally to a fruit display stand for selling fruit, for example, in a supermarket.

BACKGROUND OF THE INVENTION

Some fruits in the supermarket are typically displayed on table height display counters in open top containers. Some of the boxes may be raised higher to catch the customers' attention but not high enough to be visible from afar.

Fruits are subject to some damage from the weight of the fruits above bearing on the fruits below. Banana bunches are especially subject to damage when they are stacked several layers on top of one another. The weight of several bunches pressing on the lower bunches would tend to bruise them.

The display stand of present invention will place fruits at a higher elevation for greater visibility and will hang from the stand, thereby eliminating damage when fruits are stacked on top of one another.

SUMMARY OF THE INVENTION

The present invention provides a fruit display stand comprising a base; a first post secured to the base; transverse arms secured to an upper end portion of the first post, the transverse arms extending upwardly inclinedly from the first post; a plurality of ring members attached to the transverse arms. The ring members include an outer ring member. Other of the ring members are disposed within the outer ring member in plan view; and the other of the ring members are disposed vertically below the outer ring member.

The present invention also provides a fruit display stand, comprising a base; a first post secured to the base; transverse arms secured to an upper end portion of the first post; a plurality of horizontal members attached to the transverse arms. The horizontal members include an outer member. The other of the horizontal members are disposed inwardly of the outer horizontal member in plan view; and the other of the horizontal members being disposed vertically below the outer horizontal member.

BRIEF DESCRIPTION OF THE DRAWINGS

FIG. 2 is a top plan view of FIG. 1.

FIG. 3 is a side elevational view of FIG. 1.

DETAILED DESCRIPTION OF THE INVENTION

Figure 1:
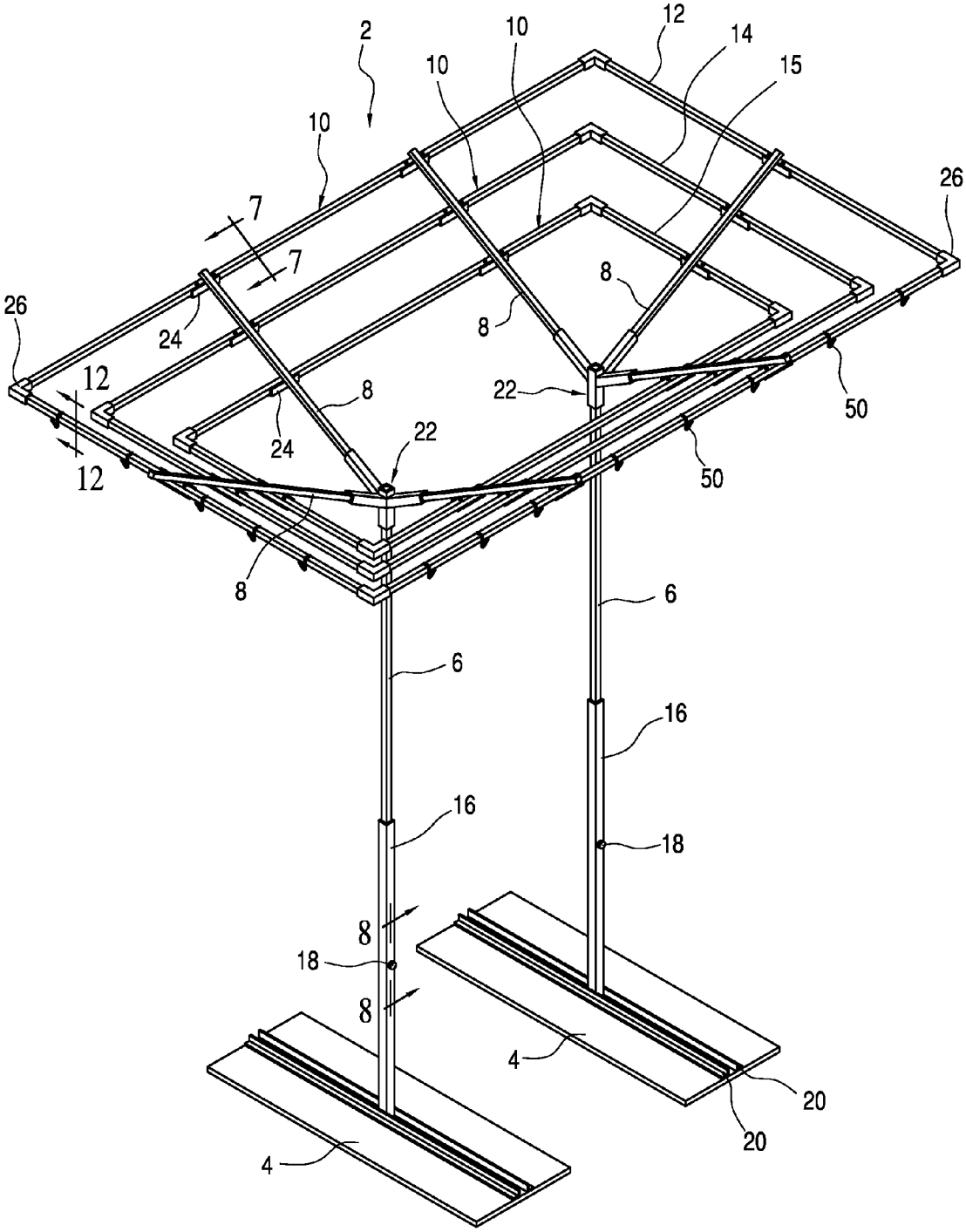
FIG. 1 is a perspective view of an embodiment of a fruit display stand made in accordance with the present invention.

A fruit display stand 2 embodying the present invention is disclosed in FIGS. 1, 2 and 3. The fruit display stand 2 includes first and second bases 4 connected to respective posts 6. A plurality of arms 8 are transversely and inclinedly attached to an upper end portion of the respective posts 6. A plurality of ring members 10 are attached to the respective arms 8. The ring members 10 may be rectangular, square (see FIG. 5), circular (see FIG. 6) or other geometric shapes.

The ring members 10 comprise an outer ring member 12 and inner ring members 14 and 15. When viewed in plan view, the inner ring members 14 and 15 are disposed within the outer ring member 12, as shown in FIG. 2. The inner ring members 14 and 15 are also disposed vertically below the outer ring member 12, since the arms 8 are disposed at an angle above the horizontal, extending laterally and upwardly from the upper end of the respective post 6, as shown in FIG. 3. As will be seen in the embodiment shown in FIG. 14, the ring members 10 may take a non-circle (not closed) shape.

The post 6 is made of tubular metal, such as a square tube, attached to the respective bases 4 through a tubular sleeve member 16 attached to the respective bases 4 by standard means, such as by welding. The post 6 has a bottom portion received within the tubular member 16 and then bolted together, such as by a through bolt 18. The post 6 may be attached directly to the respective base 4 by means of welding or other standard means. The post 6 may have other cross-sectional shape, other than square, such as round.

The post 6 may be made of other suitable material, such as plastic, wood, etc.

The bases 4 are preferably made from a metal plate, but other materials, such as wood, plastic, etc. may be used. The bases 4 may be provided with stiffeners 20 made of metal angle brackets attached to the base 4 by welding or other standard means. The bases 4 may be joined together as one unit or made from a single structure adapted to support the plural posts 6.

The arms 8 are preferably attached to the upper end portion of the respective posts 6 by means of a connector 22 having a plurality of receptacles for receiving respective end portions of the arms 8 and the upper end of the post 6. The arms 8 may also be attached to the post 6 by welding, bolts or other standard means without the use of the connector 22. The connector receptacles have inside dimensions adapted to receive an end portion of the respective arms 8 and the posts 6. The arms 8 and the posts 6 are secured to the respective connector 22 with through bolts or other standard means, such as welding, etc.

Figure 10:
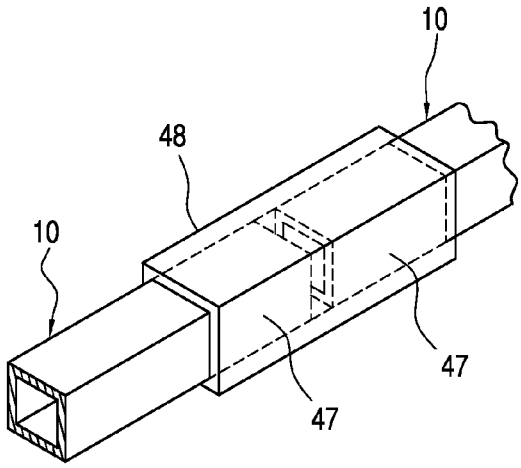
FIG. 10 is a fragmentary perspective view of a straight connector used in the present invention.

The ring members 10 are preferably made of tubular metal sections, preferably square in cross-section, joined by straight connectors 48 (see FIG. 10). Other tubular cross-sectional shapes may be used, such as round. The ring members 10 may also be made of other materials, such as wood, plastic, etc.

The ring members 10 are attached to the arms 8 by means of metal angle brackets 24, which are welded to the arms 8. The ring members 10 are bolted to the brackets 24. Other means of attaching the ring members 10 to the arms may be used, such as by directly welding the ring member 10 to the arms 8 without using the brackets 24. Bolting the arms 10 to the arms 8 may also be used in attaching the ring members 10 to the arms 8.

Right angle connectors 26 are used to connect the tubular sections at the corners that make up the ring members 10. The connectors 26 has two receptacles for receiving respective end portions of the tube sections of the ring members 10. The receptacles have inside dimensions adapted to receive an end portion of the respective end portions of the tubular sections that make up the ring members 10. The ring members 10 are made from several sections of tubular members, preferably square in cross section, that are joined together by the straight connectors 48 (see FIG. 10) or the right angle connectors 26 (see FIG. 9).

Referring to FIGS. 2 and 3, it is seen that the inclined orientation of the arms 8 and the different peripheral sizes of the ring members 10 allow the tubular sections of the ring members 14 and 15 to be disposed vertically below the outer ring member 12, and to be displaced horizontally inwardly toward the posts 6. This arrangement advantageously allows the fruits hanging from the outer ring member 12 from substantially interfering with the fruits hanging from inner ring members 14 and 15 and protects the fruits hanging from the inner ring members 14 and 15 from being substantially obscured by the fruits hanging from the outer ring member 12.

Figure 4:
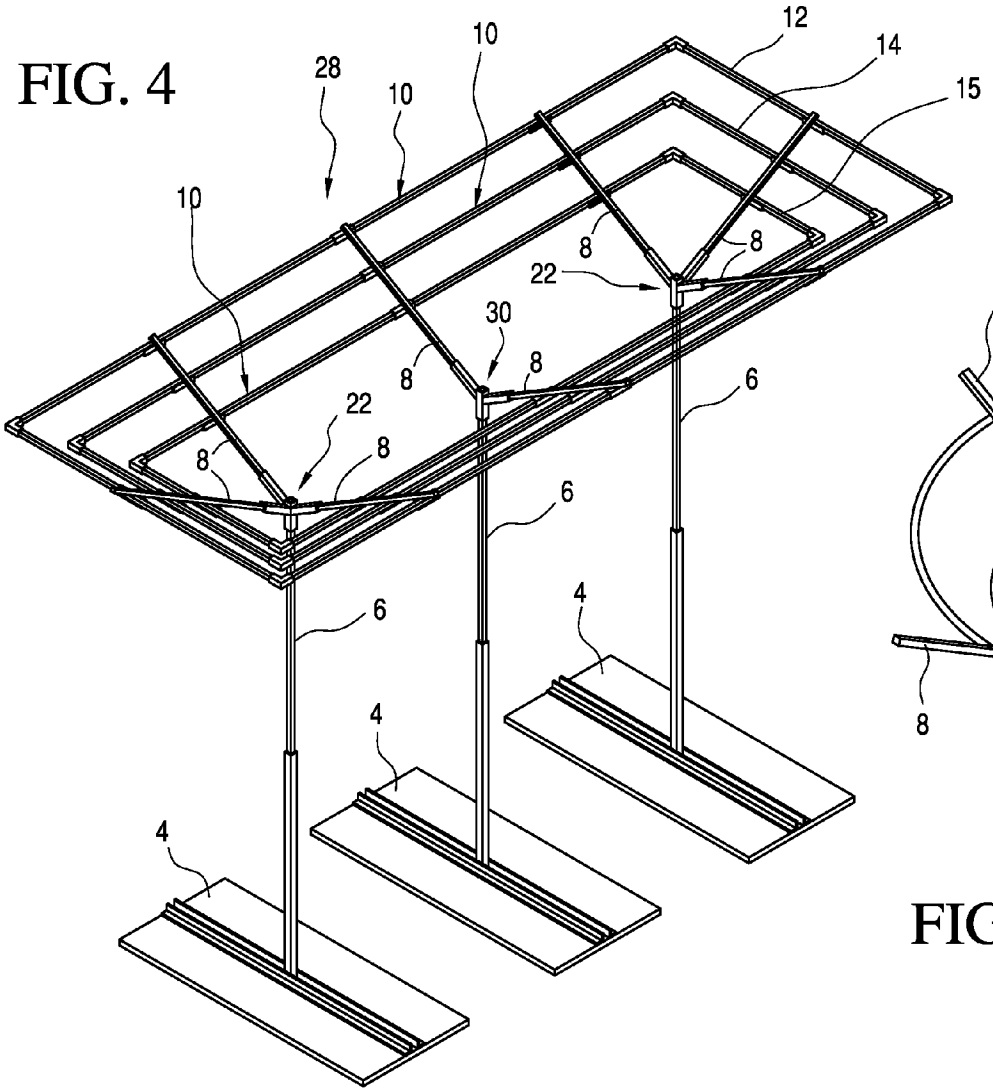
FIG. 4 is a perspective view of another embodiment of a fruit stand similar to FIG. 1.

Referring to FIG. 4, another embodiment of a fruit display stand 28 is disclosed. The fruit display stand 28 is similar to the fruit display stand 2, except that the stand 28 is longer, requiring an additional post 6 and additional transverse arms 8 for additional support. The stand 28 has connector 30 that connects the two lateral members 8 to the post 6. The connector 30 is similar to the connector 22, except that only two receptacles are provided for the arms 8 and one receptacle for the post 6. The connector receptacles have inside dimensions adapted to receive the end portions of the arms 8 and the post 6. As in the stand 2, the arms 8 may be welded directed to the posts 6 and the ring members 10 to the arms 8. Other than the additional post 6, and the connector 30, the stand 28 is made in the same way as the stand 2.

Figure 6:
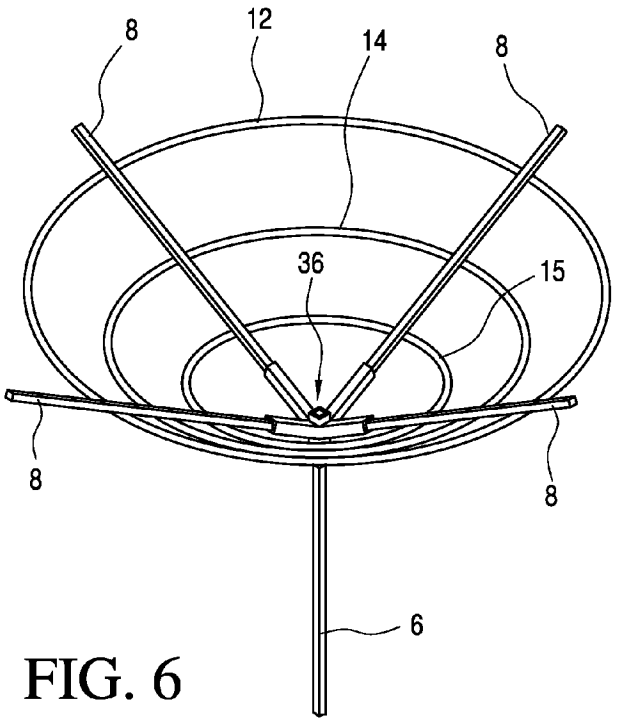
FIG. 6 is a fragmentary perspective of another embodiment of a fruit stand similar to FIG. 5.
Figure 5:
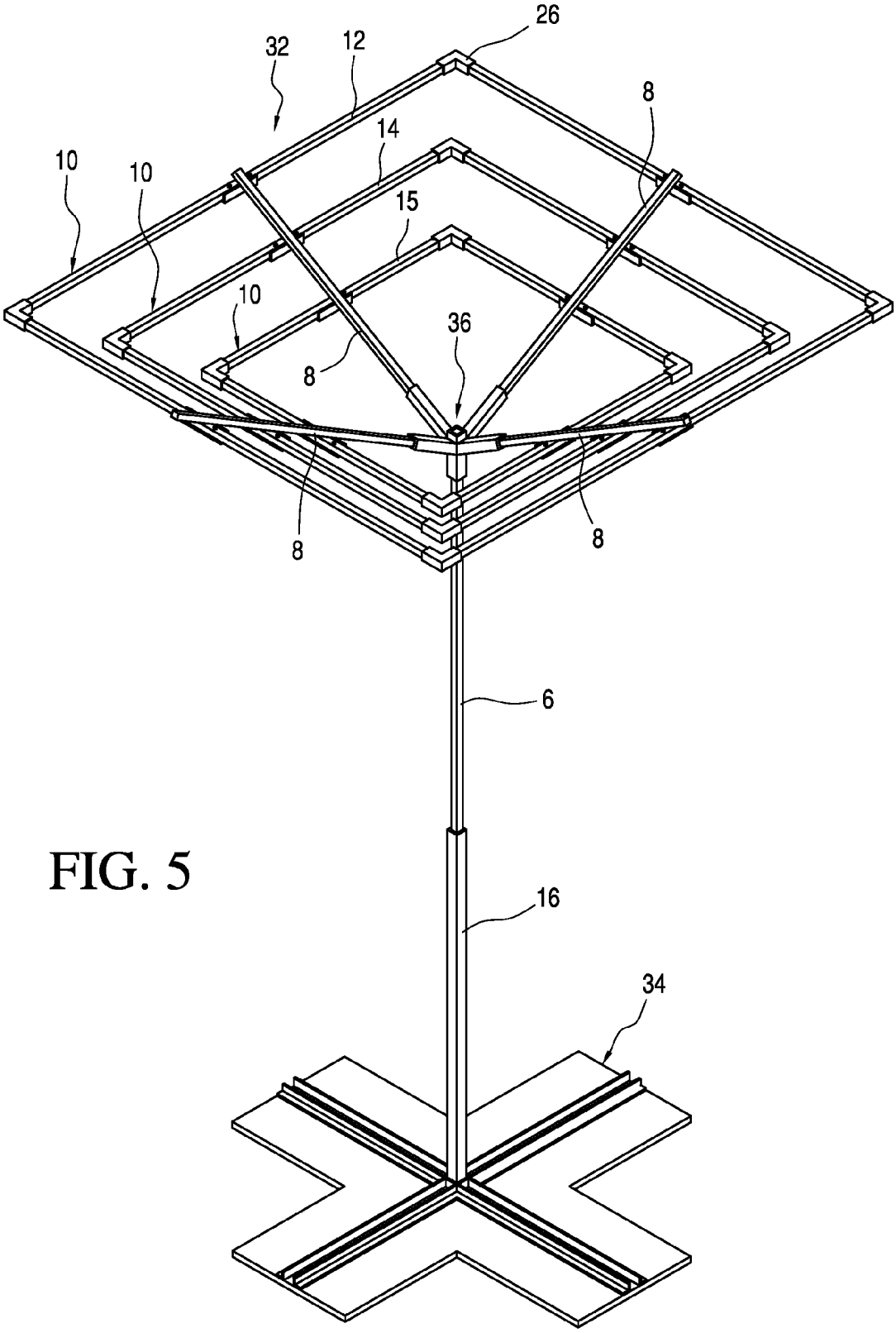
FIG. 5 is a perspective view of another embodiment of a fruit stand made in accordance with the present invention.

Referring to FIG. 5, an embodiment of a fruit display stand 32 is disclosed. The fruit display stand 32 includes a single post 6 attached to a base 34, preferably cross-shaped made of metal plates. Other shapes and materials may be used for the base 34. The sleeve member 16 receives an end portion of the post 6. The lateral arms 8 are attached to an upper end portion of post 6 with a connector 36 having a plurality of receptacles adapted to receive an end portion of the respective arms 8. The ring members 10 are preferably square in plan view or circular, as shown in FIG. 6. Other geometric shapes of the ring members 10 may be used.

Figure 7:
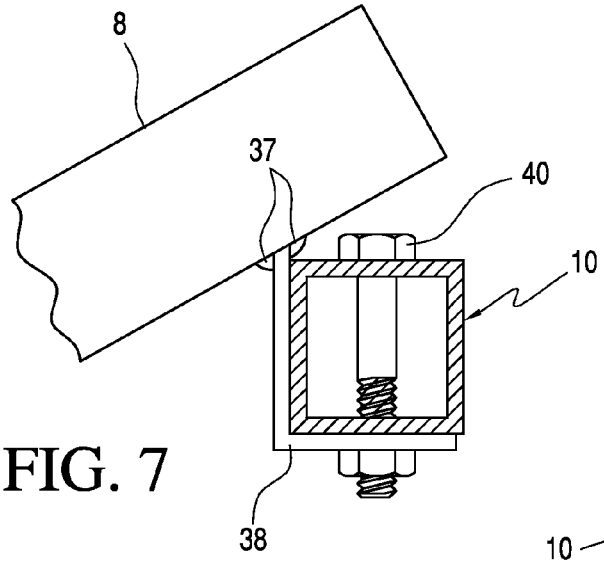
FIG. 7 is a cross-sectional view taken along line 7-7 in FIG. 1.

Referring to FIG. 7, an angle metal bracket 38 is attached to the arm 8 by welding 37 or other standard means. The ring member 10 is then supported by the angle bracket 38 and attached thereto by a through bolt 40 or other standard means. The ring member 10 may be attached directly to the arm 8, by welding or standard means, in which case, the bracket 38 may be dispensed with.

Figure 8:
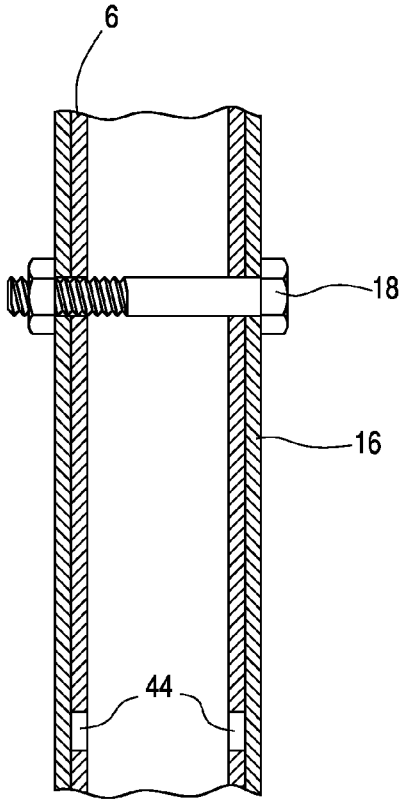
FIG. 8 is a cross-sectional view taken along line 8-8 in FIG. 1.

Referring to FIG. 8, the sleeve member 16 telescopically receives the post 6 and are secured together by a through bolt 42.

The post has a plurality of holes 44 at different heights to allow vertical adjustment of the post 6, if desired. The post 6 may be directly attached to the base 4 by welding or other standard means, in which case the sleeve member 16 may be dispensed with.

Figure 9:
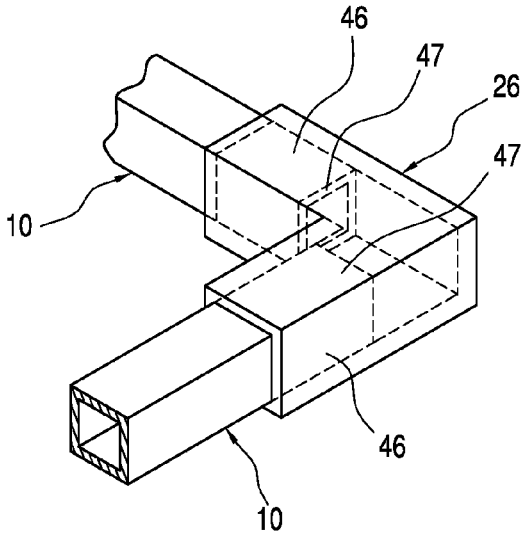
FIG. 9 is a fragmentary perspective view of a 90° connector used in the present invention.

Referring to FIG. 9, the connector 26 is shown in greater detail. Connector 26 is a 90° connector having tubular receptacles 46 having an inside dimension adapted to receive an end portion 47 of tubular members that make up the ring member 10. The connector 26 is bolted to the end portions 47 with through bolts, as similarly shown in FIG. 8. The end portions 47 of the tubular members may be joined together by welding or other standard means, in which case the connector 26 may be dispensed with.

Referring to FIG. 10, a straight connector 48 is disclosed.

The connector 48 is a tubular member having an inside dimension adopted to receive end portions 47 of the tubular members that make up the ring member 10. The connector 48 is bolted to the end portions of the tubular members of the ring member 10, as similarly shown in FIG. 8. The connector 48 may be dispensed with where the end portions of the tubular members of the ring member 10 are welded to each other or joined using other standard means.

Figure 12:
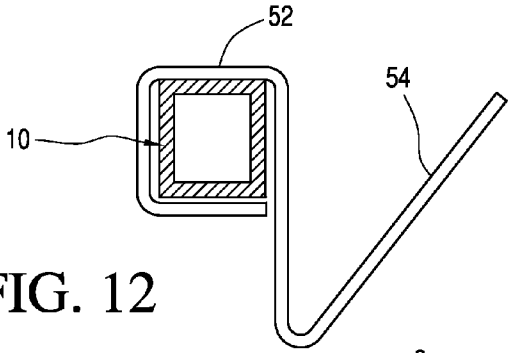
FIG. 12 is a cross-sectional view taken along line 12-12 in FIG. 1.
Figure 11:
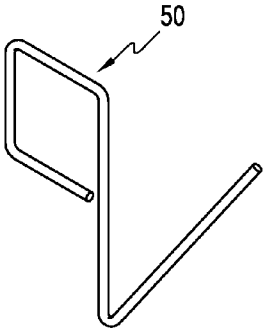
FIG. 11 is perspective view of a hanger used in the present invention.

Referring to FIGS. 11 and 12, a hanger 50 is disclosed. The hanger 50 is made of wire bent into an attachment portion 52 and a hook portion 54. The attached portion 52 encircles the cross sectional periphery of the tubular members that make up the ring member 10. Thus, the hanger 50 is captured by the tubular members of the ring member 10. This is advantageous since when fruits hanging from the hangers are taken by the customer, the hangers would stay attached to the ring member 10, rather than falling down to the floor or sticking with the fruit. The hanger 50 is slidable along the tubular members of the ring member 10 to advantageously position the fruit hanging therefrom in a more advantageous position for customer attraction. The hanger 50 may be made of plastic or other suitable materials.

Figure 13:
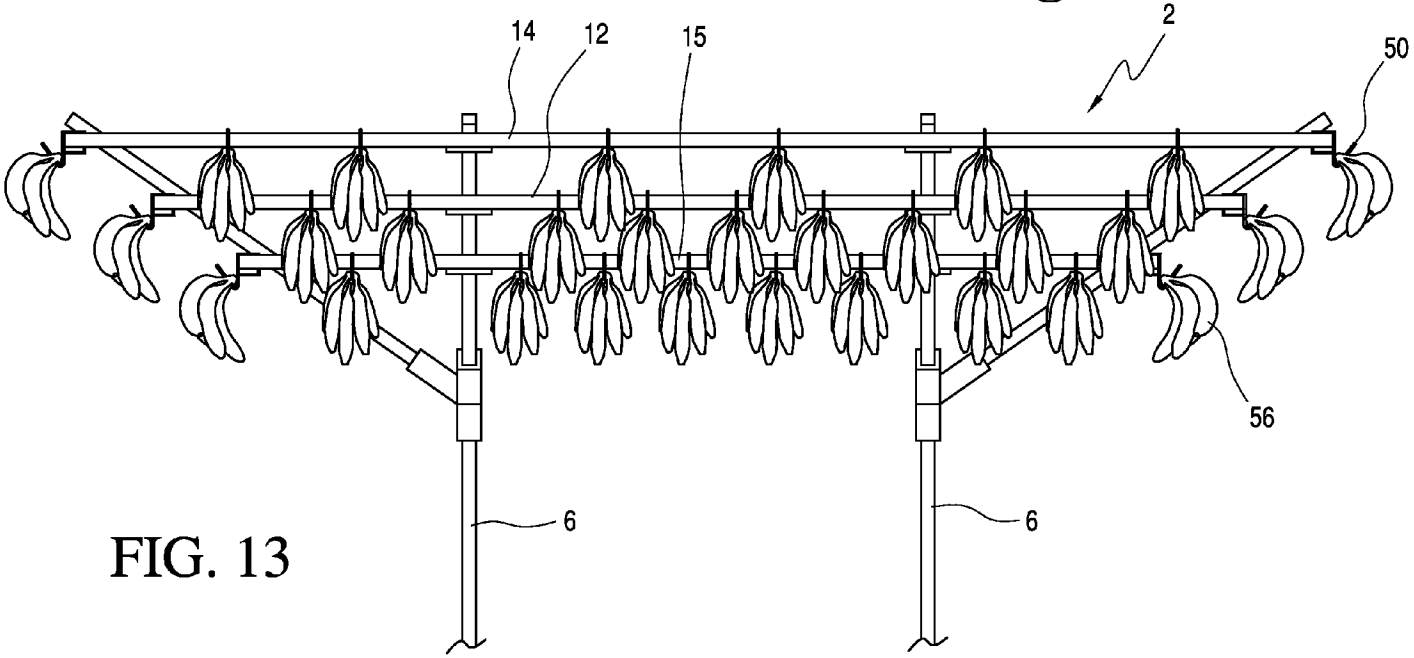
FIG. 13 is a fragmentary side elevational view of the fruit display stand of FIG. 1, showing bunches of bananas hung from the stand.

Referring to FIG. 13, the stand 2 is shown being used to display bunches of bananas. As will be appreciated, the vertical and horizontal displacement of the of the inner ring members 14 and 15 relative to the outer ring member 12 provides for greater exposure and lesser interference of the banana bunches from each other. For example, the inner ring member 14 may be about 6 in. below and about 6 in. inward of the outer ring member 12, providing sufficient space for the banana bunches hanging from the outer ring member 12 from substantially obscuring those hanging on inner ring member 14. The same can be said for the inner ring member 15, which may be disposed below the inner ring member 14 at the same distances as the inner ring member 14 is disposed below the outer ring member 12. Further, the fruits are displayed at higher elevations than the surrounding display counters, making the fruits visible from several feet away to catch the attention of the customers. For example, the outer ring member 12 may be disposed at about 6 feet, making it quite visible from a distance.

Figure 14:
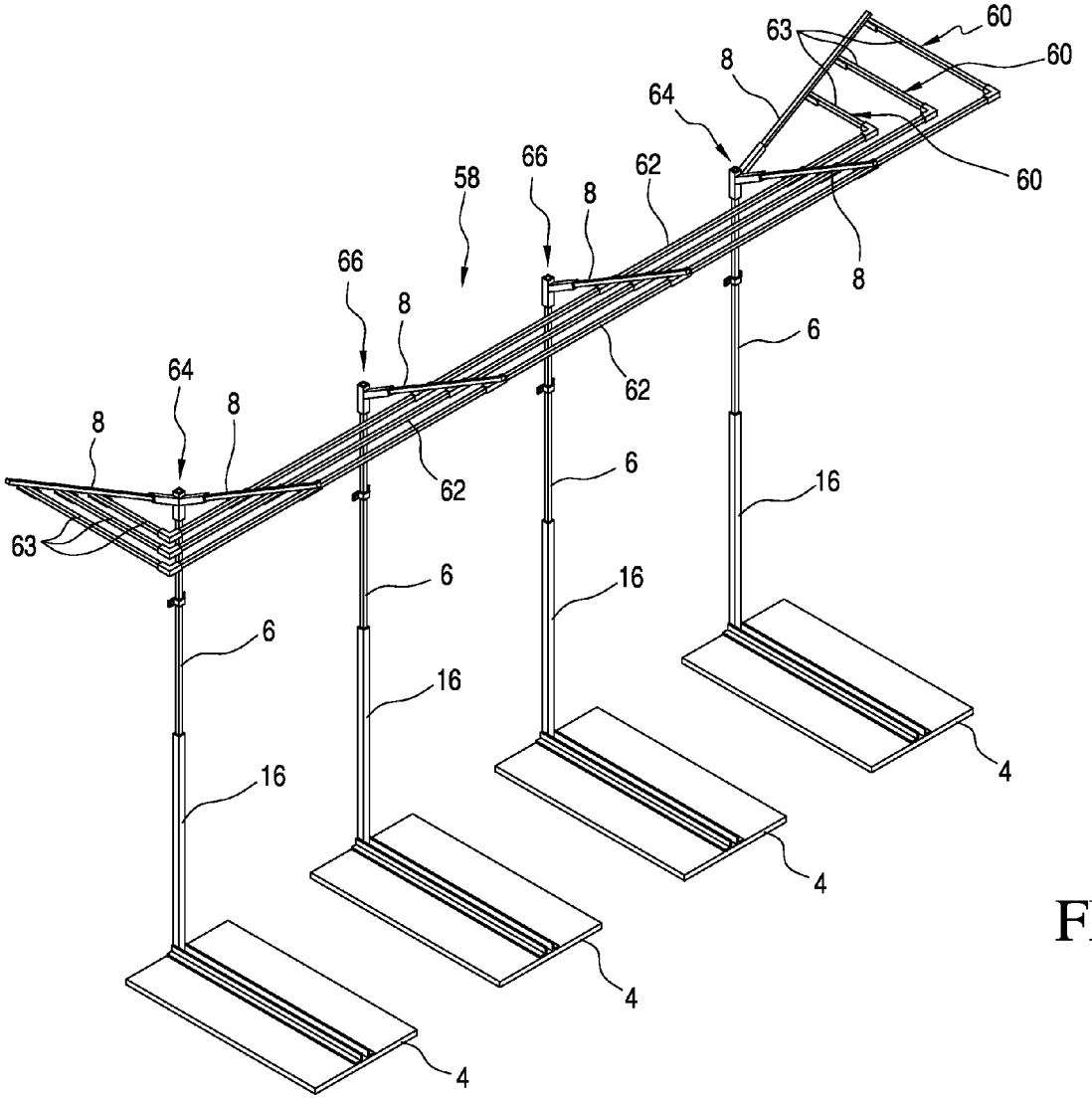
FIG. 14 is a perspective view of another embodiment of a fruit display stand made in accordance with the present invention.
Figure 15:
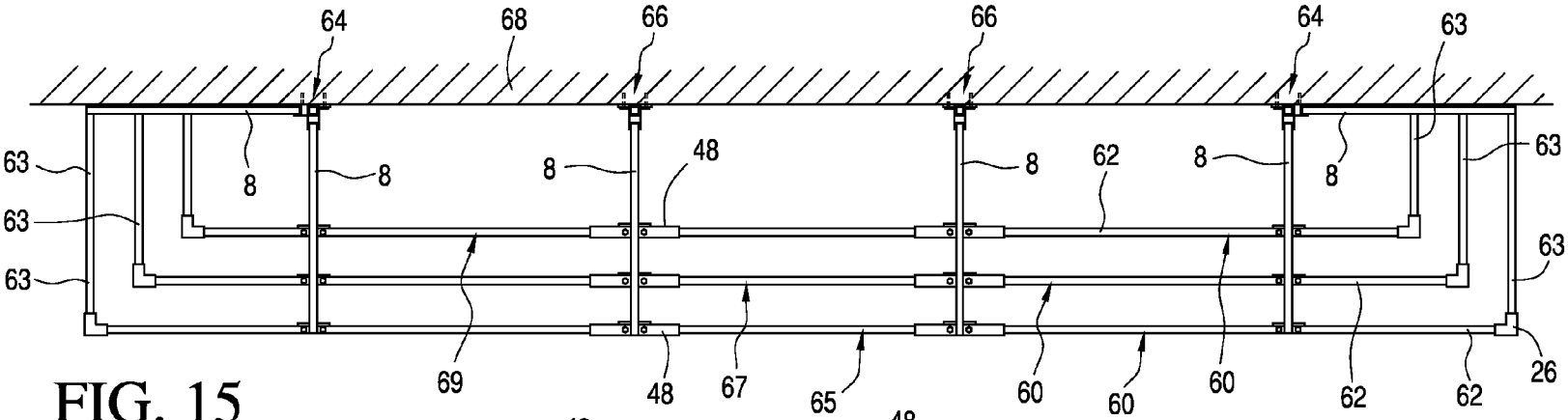
FIG. 15 is a top plan view of FIG. 14.
Figure 16:
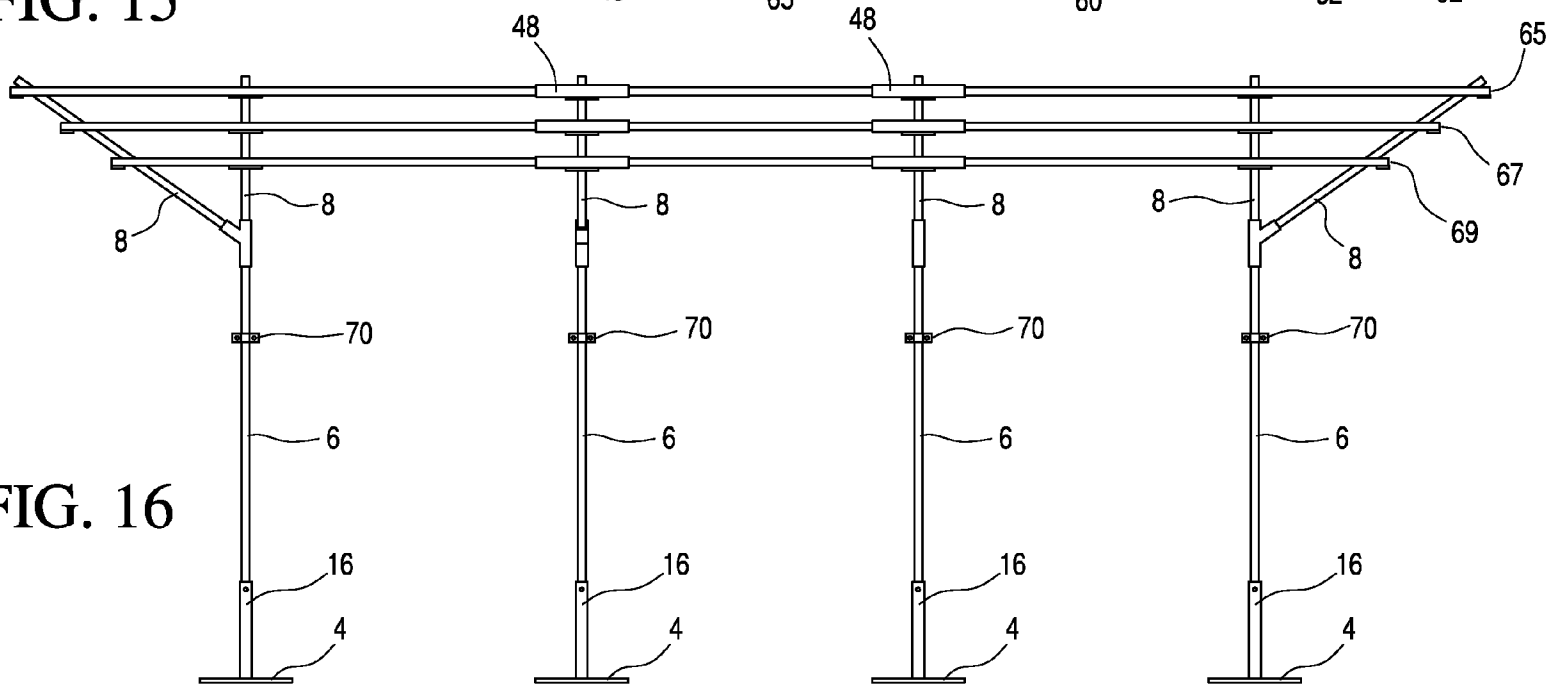
FIG. 16 is a side elevational view of FIG. 14.
Figure 17:
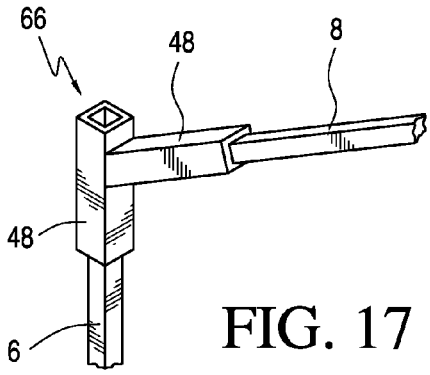
FIGS. 17-21 are enlarged perspective views of various connectors used in the present invention.
Figure 18:
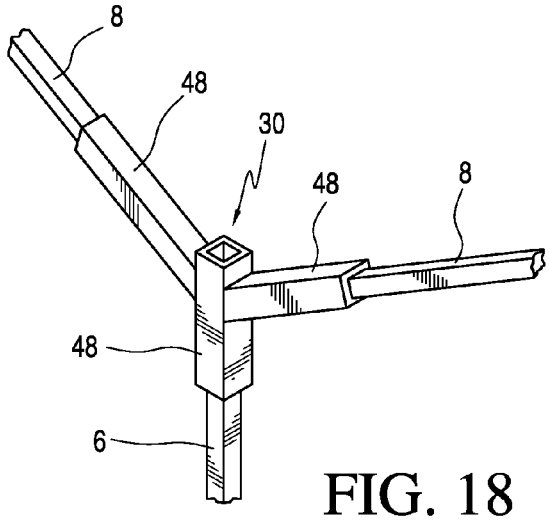
Figure 19:
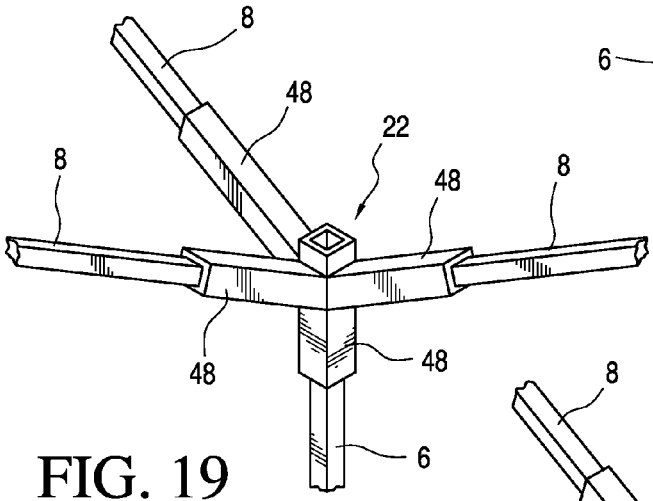
Figure 20:
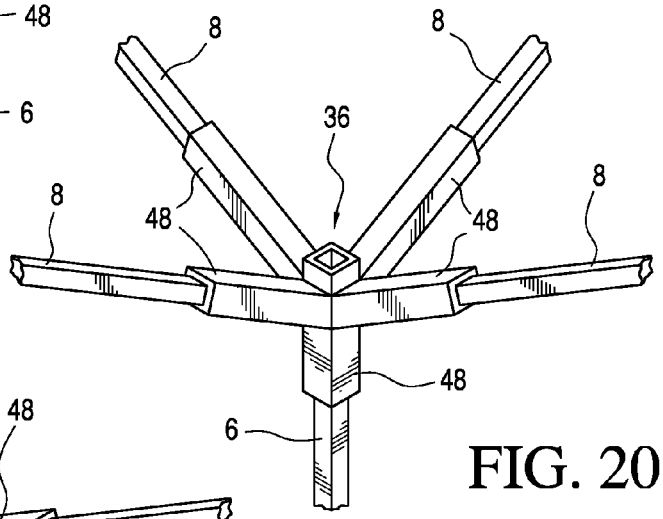
Figure 21:
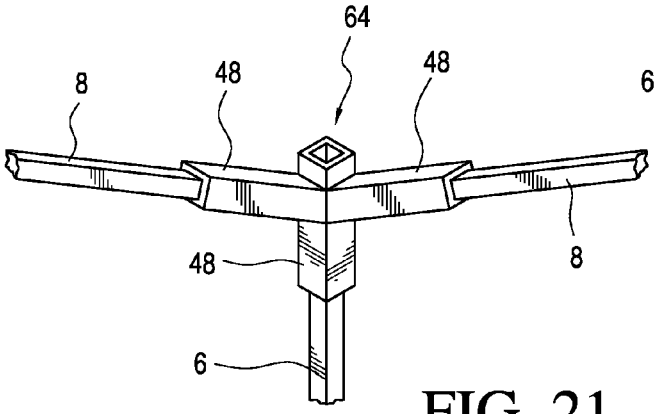

Referring to FIGS. 14, 15 and 16, another embodiment of a display stand 58 embodying the present invention is disclosed. The stand 58 has a number of U-shaped structures 60 having a series of horizontal and longitudinal members 62 and right angle members 63 spaced vertically and horizontally from each other, as viewed in plan view in FIG. 15 and elevation view in FIG. 16. The U-shaped structures 60 include an upper structure 65; a middle structure 67 below the upper structure 65 and displaced horizontally toward the posts 6; and a lower structure 69 below the middle structure 67 and disposed horizontally toward the posts 6. The longitudinal members 62 may comprise of sections joined together by the straight connectors 48. The right angle members 63 are joined to the members 62 by means of the right angle connectors 26. Connectors 64 join two arms 8 together at right angle and to the post 6. Connectors 66 join one arm 8 to the post 8. The posts 6 may be secured to an existing wall structure 68 with brackets 70 for added stability. As in the other embodiments, the various connectors may be dispensed with if the various members are welded together or attached with other standard means.

Referring to FIGS. 17-21, the various connectors used to connect the arms 8 to the posts 6 are disclosed in greater detail.

Each connector has a number of receptacles 48 with an inside dimension adapted to receive therein an end portion of the respective arms 8 and the posts 6. Through bolts as similarly shown in FIG. 8 are used to fixedly attach the arms 8 and the posts 6 to the respective connectors. The connector 30 are used to connect two arms 8 that are 180° apart in plan view. The connector 22 is used to connect three arms 8, two of which are 180° apart in plan view, and one of which is 90° apart from each of the other two arms 8. Connector 36 is used to connect four arms 8 that are 90° apart in plan view. Connector 64 is used to connect two arms 8 that are 90° apart in plan view.

The various connectors disclosed herein are advantageously useful in quickly assembling the fruit display stand on site. The various parts may be precut in the shop and delivered to the site where the various connectors make for a relatively easy and quick assembly.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A fruit display stand, comprising:

a) a base;

b) a first post secured to said base such that said first post is supported in a vertical position by said base;

c) transverse arms secured to an upper end portion of said first post, said transverse arms extending upwardly inclinedly from said first post;

d) a plurality of rigid ring members secured to said transverse arms, said ring members including an outer ring member;

e) other of said ring members being disposed within said outer ring member in plan view; and f) said other of said ring members being disposed vertically below said outer ring member.

2. A fruit display stand as in claim 1, wherein said ring members are rectangular in plan view.

3. A fruit display stand as in claim 1, wherein said ring members are circular in plan view.

4. A fruit display stand as in claim 1, wherein said ring members are square in plan view.

5. A fruit display stand as in claim 1, wherein said ring members are tubular.

6. A fruit display stand as in claim 4, wherein said ring members are square in cross section.

7. A fruit display stand as in claim 1, and further comprising hangers attached to said ring members.

8. A fruit display stand as in claim 7, wherein:

a) said hangers each includes an attachment portion bent around the cross-sectional periphery of said ring members; and b) hook portion for securing a fruit for hanging from the ring members.

9. A fruit display stand as in claim 7, wherein said hangers are made of bent wire.

10. A fruit display stand as in claim 7, wherein said hangers are slidable along said ring members to which they are attached.

11. A fruit display stand as in claim 1, and further comprising:

a) L-shaped angle members attached to said transverse arms; and b) said ring members are attached to said angle members.

12. A fruit display stand as in claim 1, and further comprising connector members for connecting lengths of said ring members together.

13. A fruit display stand as in claim 12, wherein said connector members are longitudinal.

14. A fruit display stand as in claim 12, wherein said connector members are L-shaped.

15. A fruit display stand as in claim 1, wherein said base is a metal plate.

16. A fruit display stand as in claim 1, and further comprising:

a) a second post secured to another base such that said second post is supported in a vertical position by said another base; and b) another transverse arms secured to said second post and said ring members.

17. A fruit display stand as in claim 1, and further comprising:

a) a tubular sleeve member attached to said base in a vertical position; and b) said first post includes a bottom end portion received with said tubular sleeve member.

18. A fruit display stand as in claim 1, and further comprising:

a) a connector for securing said transverse arms to said end portion of said first post; and b) said connector including a plurality of receptacles for receiving respective end portions of said arms and said upper end of said post.

19. A fruit display stand, comprising:

a) a base;

b) a first post secured to said base such that said first post is supported in a vertical position by said base;

c) transverse arms secured to an upper end portion of said first post;

d) a plurality of horizontal rigid members secured to said transverse arms, said horizontal members including an outer member;

e) other of said horizontal members being disposed inward of said outer horizontal member in plan view; and f) said other of said horizontal members being disposed vertically below said outer horizontal member.

20. A fruit display stand as in claim 19, wherein said horizontal members are U-shaped.

21. A fruit display stand as in claim 19, wherein said first post is adjustable vertically.

* * * * *